US009452913B2

(12) United States Patent
Dell'Aquila

(10) Patent No.: US 9,452,913 B2
(45) Date of Patent: Sep. 27, 2016

(54) TELESCOPIC BOOM

(71) Applicant: CNH Industrial America LLC, New Holland, PA (US)

(72) Inventor: Pietro Dell'Aquila, Carmiano Lecce (IT)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/653,949

(22) PCT Filed: Dec. 17, 2013

(86) PCT No.: PCT/EP2013/076823

§ 371 (c)(1),
(2) Date: Jun. 19, 2015

(87) PCT Pub. No.: WO2014/095803

PCT Pub. Date: Jun. 26, 2014

(65) Prior Publication Data

US 2015/0314996 A1 Nov. 5, 2015

(30) Foreign Application Priority Data

Dec. 20, 2012 (IT) ..... MO2012A0312

(51) Int. Cl.

| | |
|---|---|
| ***B66C 23/06*** | (2006.01) |
| ***B66C 23/70*** | (2006.01) |
| ***B66F 9/08*** | (2006.01) |
| ***B66F 11/04*** | (2006.01) |
| ***B66C 13/12*** | (2006.01) |

(52) U.S. Cl.

CPC ..... *B66C 23/703* (2013.01); *B66C 13/12* (2013.01); *B66C 23/701* (2013.01); *B66C 23/705* (2013.01); *B66F 9/08* (2013.01); *B66F 11/046* (2013.01)

(58) Field of Classification Search

CPC ... B66C 23/703; B66C 23/705; B66C 13/12; B66F 11/046; B66F 9/08

See application file for complete search history.

(56) References Cited

U.S. PATENT DOCUMENTS 3,638,806 A * 2/1972 Hippach ..... 212/231
3,648,850 A * 3/1972 Rochon et al. ..... 212/350

(Continued)

FOREIGN PATENT DOCUMENTS

CN 201132756 Y 10/2008
CN 201560104 U 8/2010

(Continued)

*Primary Examiner* — Brian Mattei
*Assistant Examiner* — Gisele Ford
(74) *Attorney, Agent, or Firm* — Peter K. Zacharias; Patrick M. Sheldrake

(57) ABSTRACT

A telescopic boom extending along a longitudinal axis includes a base section intended to be connected to a frame of a machine for lifting loads, a plurality of movable sections, a hydraulic cylinder connecting the base section to a first movable section of said plurality for extending the first movable section relative to the base section, at least one extension chain between the base section and a second movable section for extending the second movable section relative to the first movable section, at least one further extension chain interposed between the first movable section and a third movable section for extending the third movable section relative to the second movable section, the extension chain and the further extension chain located at opposite sides of the longitudinal axis.

21 Claims, 4 Drawing Sheets

(56) References Cited

U.S. PATENT DOCUMENTS

| | | | | |
|---|---|---|---|---|
| 3,777,629 | A * | 12/1973 | Johnston et al. | 91/524 |
| 3,804,262 | A * | 4/1974 | Wiencek et al. | 212/349 |
| 4,406,375 | A | 9/1983 | Hockensmith | |
| 5,330,032 | A * | 7/1994 | Warner | 187/226 |
| 5,465,855 | A | 11/1995 | Erdmann | |
| 5,718,345 | A * | 2/1998 | Hade, Jr. | 212/349 |
| 5,924,837 | A * | 7/1999 | Passmann | 414/718 |
| 2003/0205547 | A1* | 11/2003 | Dupre et al. | 212/349 |
| 2006/0042175 | A1* | 3/2006 | Crespi | 52/111 |
| 2006/0086566 | A1 | 4/2006 | Linsmeier et al. | |
| 2015/0151954 | A1* | 6/2015 | Magni | 212/348 |

FOREIGN PATENT DOCUMENTS

| | | | |
|---|---|---|---|
| CN | 201737663 | U | 2/2011 |
| CN | 201980948 | U | 9/2011 |
| CN | 202148151 | U | 2/2012 |
| WO | 2010145545 | A1 | 12/2010 |

* cited by examiner

TELESCOPIC BOOM

CROSS REFERENCE TO RELATED APPLICATION

This application is the US National Stage filing of International Application Serial No. PCT/EP2013/076823 filed on Dec. 17, 2013 which claims priority to Italian Application MO2012A000312 filed Dec. 20, 2012, each of which is incorporated herein by reference in its entirety.

FIELD OF THE INVENTION

The invention relates to a telescopic boom, which can be used for lifting loads for example in a telescopic handler, a crane, a forklift, or in an aerial lift platform apparatus. The telescopic boom according to the invention is made of at least four sections.

BACKGROUND OF THE INVENTION

It is known to extend or retract a telescopic boom by means of a movement arrangement comprising a hydraulic cylinder and one or more chains.

For example, GB 2080244 discloses a telescopic boom including a base section, an inner mid section, an outer mid section and a fly section. A hydraulic cylinder has a rear end connected to a side wall of the base section and a piston rod fixed relative to a side wall of the inner mid section. A first pair of extension chains have respective first ends anchored to a bottom plate of the base section and respective second ends anchored to a bottom plate of the outer mid section. The extension chains of the first pair are wound around respective sprockets at the rear end of the inner mid section. The telescopic boom disclosed in GB 2080244 further comprises a second pair of extension chains having respective first ends anchored to a bottom plate of the inner mid section and respective second ends anchored to a bottom plate of the fly section. The extension chains of the second pair are wound around respective sprockets fixed to a rearward end of the outer mid section. Retraction chains are further provided in order to retract the telescopic boom.

A drawback of the telescopic boom disclosed in GB 2080244 is that, since both the pairs of extension chains are located on the bottom side of the boom, in operation stresses are generated that are not uniformly distributed.

This may result in larger deflections of the sections of the telescopic boom. Consequently, it is necessary to adopt larger wall thicknesses, enlarged cross-sections, and/or better performing materials.

Further examples of telescopic booms having sections moved by a combination of hydraulic cylinders and chains are disclosed in Chinese utility models no. CN 201980948U and CN 201560104U.

SUMMARY OF THE INVENTION

An object of the invention is to improve telescopic booms, particularly to be used in machines for lifting loads.

A further object is to provide a telescopic boom which, in operation, is subjected to stresses that are more uniformly distributed than in prior art booms.

Another object is to reduce deflections in telescopic booms.

A still further object is to provide a telescopic boom which is less expensive than existing ones, for example because it has reduced thicknesses, or smaller cross-sections, or it is made of less expensive materials.

According to the invention, there is provided a telescopic boom extending along a longitudinal axis, comprising:

- a base section intended to be connected to a frame of a machine for lifting loads,
- a plurality of movable sections,
- a hydraulic cylinder connecting the base section to a first movable section of said plurality for extending the first movable section relative to the base section,
- at least one extension chain interposed between the base section and a second movable section of said plurality for extending the second movable section relative to the first movable section,
- at least one further extension chain interposed between the first movable section and a third movable section of said plurality for extending the third movable section relative to the second movable section, characterized in that the extension chain and the further extension chain are located at opposite sides of the longitudinal axis.

By positioning the extension chain and the further extension chain at opposite sides of the longitudinal axis, it is possible to obtain a more uniform distribution of stresses on the sections of the telescopic boom, when the latter is in operation. Consequently, deflection of the sections which form the telescopic boom is less relevant, and dimensioning the components of the telescopic boom is not as critical as in the prior art. In particular, the thicknesses of the components and/or the cross-sections thereof can be reduced, and cheaper materials can be chosen. Hence, the telescopic boom is less expensive.

In particular, the extension chain can be located below the longitudinal axis, i.e. at the lower side of the longitudinal axis. In this case, the further extension chain will be located above the longitudinal axis, i.e. at the upper side thereof.

In an embodiment, the hydraulic cylinder is located at a side of the longitudinal axis opposite the extension chain.

This arrangement is optimized from the point of view of space constraints.

Furthermore, locating the hydraulic cylinder opposite the extension chain allows a better stress balancing to be achieved.

For example, if the extension chain is located below the longitudinal axis (i.e. at the lower side thereof), the hydraulic cylinder will be located above the longitudinal axis, i.e. at the upper side thereof.

The telescopic boom may further comprise retraction chains for moving the sections which form the boom from an extended configuration to a retracted configuration. In particular, at least one retraction chain may be interposed between the base section and the second movable section for retracting the second movable section relative to the first movable section.

At least one further retraction chain may be interposed between the first movable section and the third movable section for retracting the third movable section relative to the second movable section.

In an embodiment, the retraction chain and the further retraction chain are located at opposite sides of the longitudinal axis.

For example, if the retraction chain is located on the lower side of the longitudinal axis, i.e. below the longitudinal axis, the further retraction chain will be located on the upper side of the longitudinal axis, i.e. above the longitudinal axis.

By positioning the retraction chain and the further retraction chain on opposite sides of the longitudinal axis, the distribution of stresses which arise when the telescopic boom is retracted can be kept at a reduced level.

The retraction chain may be either on the same side as the corresponding extension chain relative to the longitudinal axis, or on a side opposite the corresponding extension chain relative to the longitudinal axis.

The same applies to the further retraction chain, if compared with the further extension chain.

The telescopic boom may further comprise an arrangement of conduits for sending an operating fluid from a source located on the machine to a point of use located on a final section of the boom, for example on the third section.

A group of conduits of the arrangement of conduits may be obtained inside rigid tubes. A further group of conduits of the arrangement of conduits may be obtained inside flexible hoses.

A flexible hose may extend along a movable section of the telescopic boom and may be interposed between a rigid tube extending along the movable section located upstream of the flexible hose and a further rigid tube extending along a further movable section located downstream of the flexible hose.

By alternating the rigid tubes and the flexible hoses, it is possible to optimize encumbrance and coordinated movement of the tubes/hoses.

BRIEF DESCRIPTION OF THE DRAWINGS

The invention will be better understood and carried out with reference to the enclosed drawings, which show some exemplifying and non-limiting embodiments thereof, in which.

DETAILED DESCRIPTION OF THE INVENTION

Figure 1:
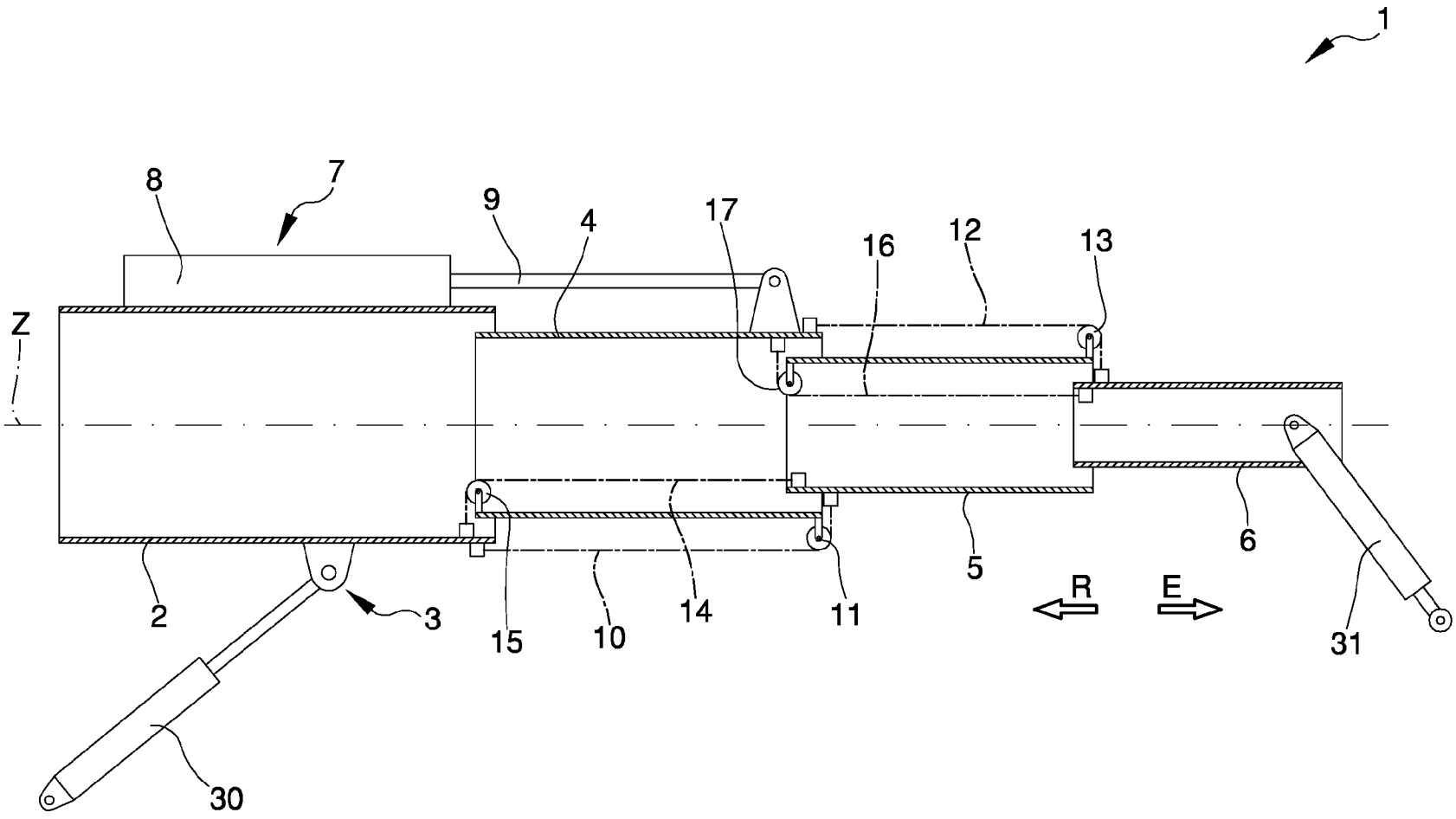
FIG. 1 is a schematic side view of a telescopic boom in an extended configuration, showing driving means for moving a plurality of sections of the boom.
Figure 2:
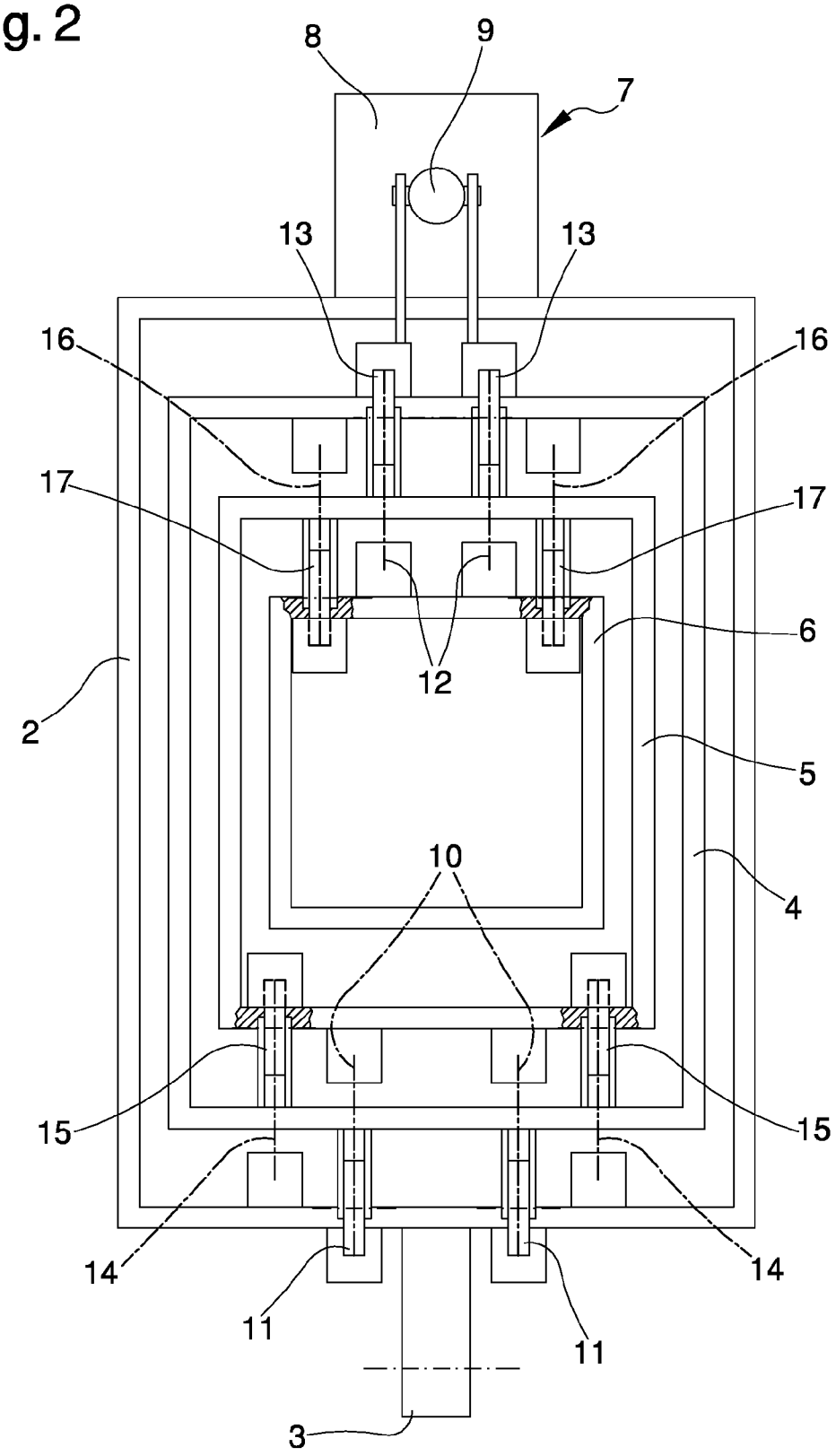
FIG. 2 is a schematic and enlarged front view of the telescopic boom of FIG. 1.

FIGS. 1 and 2 show schematically a telescopic boom 1, intended to be used in a machine for lifting loads such as a telescopic handler, a crane, a forklift, or a machine for lifting an aerial platform.

The telescopic boom 1 comprises a base section 2, intended to be connected to a main frame of the lifting machine. In particular, the base section 2 is tiltable relative to the main frame of the lifting machine owing to a hydraulic actuator 30 connected to the base section 2 at a hinge point 3 thereof. In particular, the hydraulic actuator 30 has a cylinder body which is anchored to the main frame of the lifting machine and a rod which ends at the hinge point 3.

The base section 2 has a box-like structure and is internally hollow, so as to be capable of housing, in a retracted configuration of the telescopic boom 1, a plurality of movable sections.

In the embodiment shown in FIGS. 1 and 2, said plurality of movable sections comprises a first movable section 4, a second movable section 5 and a third movable section 6. An attachment for lifting the load can be supported by the third movable section 6, which hence acts as a final section. The first movable section 4 and the second movable section 5 act as mid sections, since they are interposed between the base section 2 and the third movable section 6 or final section.

Thus, the telescopic boom 1 shown in FIGS. 1 and 2 comprises four sections. However, in an embodiment which is not shown, the telescopic boom could comprise more than four sections.

The attachment for lifting the load, which is not shown, may be connected to a hydraulic actuator element 31, for example by means of a quick coupling. The hydraulic actuator element 31 may be for example used for tilting the attachment in a desired position.

The telescopic boom 1 extends along a longitudinal axis Z. The telescopic boom 1 is movable between a retracted configuration, in which the length of the telescopic boom 1 along the longitudinal axis is at a minimum, and an extended configuration, shown in FIG. 1, in which its length along the longitudinal axis Z is at a maximum.

The first movable section 4 and the second movable section 5 have a box-like structure and are hollow. The cross-section of the first movable section 4 is smaller than the cross-section of the base section 2, so that, in the retracted configuration of the telescopic boom 1, the first movable section 4 can be received inside the base section 2.

Similarly, the second movable section 5 has a cross-section which is smaller than the cross-section of the first movable section 4, so that the second movable section 5 can be housed inside the first movable section 4, when the telescopic boom 1 is retracted.

Finally, the cross-section of the third movable section 6 is smaller than the cross-section of the second movable section 5, so that the third movable section 6 can be received inside the second movable section 5, when the telescopic boom is in the retracted configuration.

The telescopic boom 1 further comprises driving means for moving the movable sections relative to one another.

The driving means may comprise a hydraulic cylinder 7 having a body 8 which is fixed to the base section 2. The hydraulic cylinder 7 has a rod 9 which is slidable relative to the body 8. The rod 9 is fixed to the first movable section 4.

In the embodiment shown in FIG. 1, the hydraulic cylinder 7 is located on an upper side of the telescopic boom 1, i.e. above the longitudinal axis Z. However, this feature is no essential.

In the following description, the terms "upper" or "lower", as well as the terms "above" and "below", will refer to the telescopic boom 1 when installed on the lifting machine, and when arranged in an oblique or horizontal position, as shown in FIG. 1.

The driving means further comprise a plurality of chains for causing the movable sections to slide relative to one another when the hydraulic cylinder 7 is actuated.

In particular, at least one extension chain 10 is provided, connecting the base section 2 to the second movable section 5. The extension chain 10 has an end anchored to a forward portion of the base section 2 and a further end anchored to a rearward portion of the second movable section 5.

In the following description, the term "forward" refers to a side of a component facing the load to be lifted, i.e. facing away of the machine. The term "rearward", on the other hand, refers to a side of a component on an opposite side relative to the load to be lifted, i.e. facing towards the machine.

In the extended configuration, the extension chain 10 extends externally of the first movable section 4, i.e. it runs along the first movable section 4 while facing an outer surface thereof.

The extension chain 10 passes over a pulley 11 which is freely rotatable and is located at a forward end of the first movable section 4.

The driving means further comprise a further extension chain 12 connecting the first movable section 4 to the third movable section 6. The further extension chain 12 has an end anchored to a forward portion of the first movable section 4 and a further end anchored to a rearward portion of the third movable section 6. The further extension chain 12 is wound on a further pulley 13 which is freely rotatable and is provided at a forward portion of the second movable section 5.

In the extended configuration of the telescopic boom 1, the further extension chain 12 is arranged externally of the second movable section 5, so as to run along the second movable section 5 while facing an outer surface thereof.

In order to optimize stress distribution, the extension chain 10 and the further extension chain 12 are located at opposite sides of the longitudinal axis Z.

In the embodiment shown in FIG. 1, the extension chain 10 is located on a lower side of the telescopic boom 1, i.e. below the longitudinal axis Z. The further extension chain 12, on the other hand, is located on an upper side of the longitudinal axis Z, i.e. above the longitudinal axis Z.

Furthermore, the extension chain 10 is located at a side of the telescopic boom 1 opposite the hydraulic cylinder 7 relative to the longitudinal axis Z. In the embodiment shown in FIG. 1, the extension chain 10 is located at a lower side of the telescopic boom 1, i.e. below the longitudinal axis Z. The hydraulic cylinder 7 is instead located on an upper side of the telescopic boom 1, i.e. above the longitudinal axis Z.

Although this relative arrangement of the hydraulic cylinder 7 and of the extension chain 10 is not essential, it nevertheless makes easier to avoid interference between the hydraulic cylinder 7 and the extension chain 10, which both interact with the first movable section 4. Furthermore, by locating the extension chain 10 at the opposite side of the longitudinal axis Z relative to the hydraulic cylinder 7, the distribution of stresses arising during operation of the telescopic boom 1 can be rendered even more balanced.

The driving means further comprise a plurality of retraction chains for displacing the movable sections of the telescopic boom 1 towards the retracted configuration.

In particular, at least one retraction chain 14 is provided, which connects the base section 2 to the second movable section 5. The retraction chain 14 has one end anchored to a forward portion of the base section 2 and a further end anchored to a rearward portion of the second movable section 5. The retraction chain 14 passes over a pulley member 15 which is supported at a rearward end of the first movable section 4.

In the embodiment of FIG. 1, in the extended configuration, the retraction chain 14 extends mainly inside the first movable section 4. In other words, the retraction chain 14 runs along the first movable section 4 while facing an inner surface thereof. Thus, in this embodiment, the extension chain 10 and the retraction chain 14 extend on the same side of the telescopic boom 1 relative to the longitudinal axis Z, particularly below the longitudinal axis Z. The only wall interposed between the retraction chain 14 and the extension chain 10 is a bottom wall of the first movable section 4.

At least one further retraction chain 16 can be provided, which connects the first movable section 4 to the third movable section 6. The further retraction chain 16 has an end anchored to a forward portion of the first movable section 4 and a further end anchored to a rearward portion of the third movable section 6. The further retraction chain 16 passes over a pulley member 17 provided at a rearward portion of the second movable section 5.

In the extended configuration, the further retraction chain 16 mainly extends inside the second movable section 5. In other words, the further retraction chain 16 runs parallelly to the longitudinal axis Z and faces an inner surface of the second movable section 5. Hence, in this embodiment, the further extension chain 12 and the further retraction chain 16 extend on the same side of the telescopic boom 1 relative to the longitudinal axis Z, particularly above the longitudinal axis Z. The only wall separating the further extension chain 12 from the further retraction chain 16 is an upper wall of the second movable section 5.

The retraction chain 14 and the further retraction chain 16 are arranged on opposite sides of the telescopic boom 1 relative to the longitudinal axis Z.

In the embodiment shown in FIG. 1, the retraction chain 14 extends on a lower side of the telescopic boom 1, i.e. below the longitudinal axis Z. On the other hand, the further retraction chain 16 extends on an upper side of the telescopic boom 1, i.e. above the longitudinal axis Z. This arrangement of the retraction chain 14 and the further retraction chain 16 makes the stresses which arise during operation of the telescopic boom 1 more uniformly distributed.

In order to go from the retracted configuration to the extended configuration, the telescopic boom 1 works as follows. The rod 9 of the hydraulic cylinder 7 is moved out of the body 8 by sending a pressurized fluid from a hydraulic circuit of the machine into a chamber provided inside the body 8. Thus, the rod 9 moves to an extended position and the first movable section 4 is pushed out of the base section 2 by translating in an extension direction E parallel to the longitudinal axis Z.

The pulley 11 is also moved along the extension direction E, together with the first movable section 4 which supports it. Since the end of the extension chain 10 anchored to the base section 2 is in a stationary position, the third movable section 5 is extracted out of the second movable section 4 and slides along the extension direction E. This causes the further pulley 13 to be translated along the extension direction E, so that the further extension chain 12 pulls the third movable section 6 out of the second movable section 5. The third movable section 6 thus translates along the extension direction E relative to the second movable section 5.

It is clear from the above that the hydraulic cylinder 7 acts as a prime mover which actively extracts the first movable section 4 from the base section 2. The extension chain 10 and the further extension chain 12 passively follow movement of the hydraulic cylinder 7 and extract respectively the second movable section 5 from the first movable section 4 and the third movable section 6 from the second movable section 5.

The telescopic boom 1 therefore reaches the extended configuration.

The hydraulic actuator 30 positions the telescopic boom 1 so that it forms a desired angle with the ground. Thus, the hydraulic actuator 30 serves to lift the telescopic boom 1 relative to the main frame of the lifting machine, so that the telescopic boom may reach the desired height.

In order to pass from the extended configuration to the retracted configuration, a similar sequence of steps is followed.

In particular, the rod 9 of the hydraulic cylinder 7 is recalled inside the body 8, thereby displacing the first movable section 4 along a retraction direction R parallel to the longitudinal axis Z and opposite the extension direction E. The first movable section 4 is thus moved towards the inside of the base section 2. Simultaneously, the retraction chain 14 displaces the second movable section 5 along the retraction direction R relative to the first movable section 4, so that the second movable section 5 is recalled inside the first movable section 4. The further retraction chain 16 causes the third movable section 6 to translate backward relative to the second movable section 5 along the retraction direction R, so as to be received inside the second movable section 5. The retracted configuration is thus reached.

As shown in FIG. 2, a pair of extension chains 10 and a pair of further extension chains 12 can be used, instead of using a single extension chain 10 and a single further extension chain 12. The two extension chains 10 run parallel to one another, as well as the two further extension chains 12.

Similarly, a pair of retraction chains 14 and a pair of further retraction chains 16 can be used, instead of using a single retraction chain 14 and a single further retraction chain 16. The two retraction chains 14 extend parallelly to one another, as well as the two further retraction chains 16.

Figure 3:
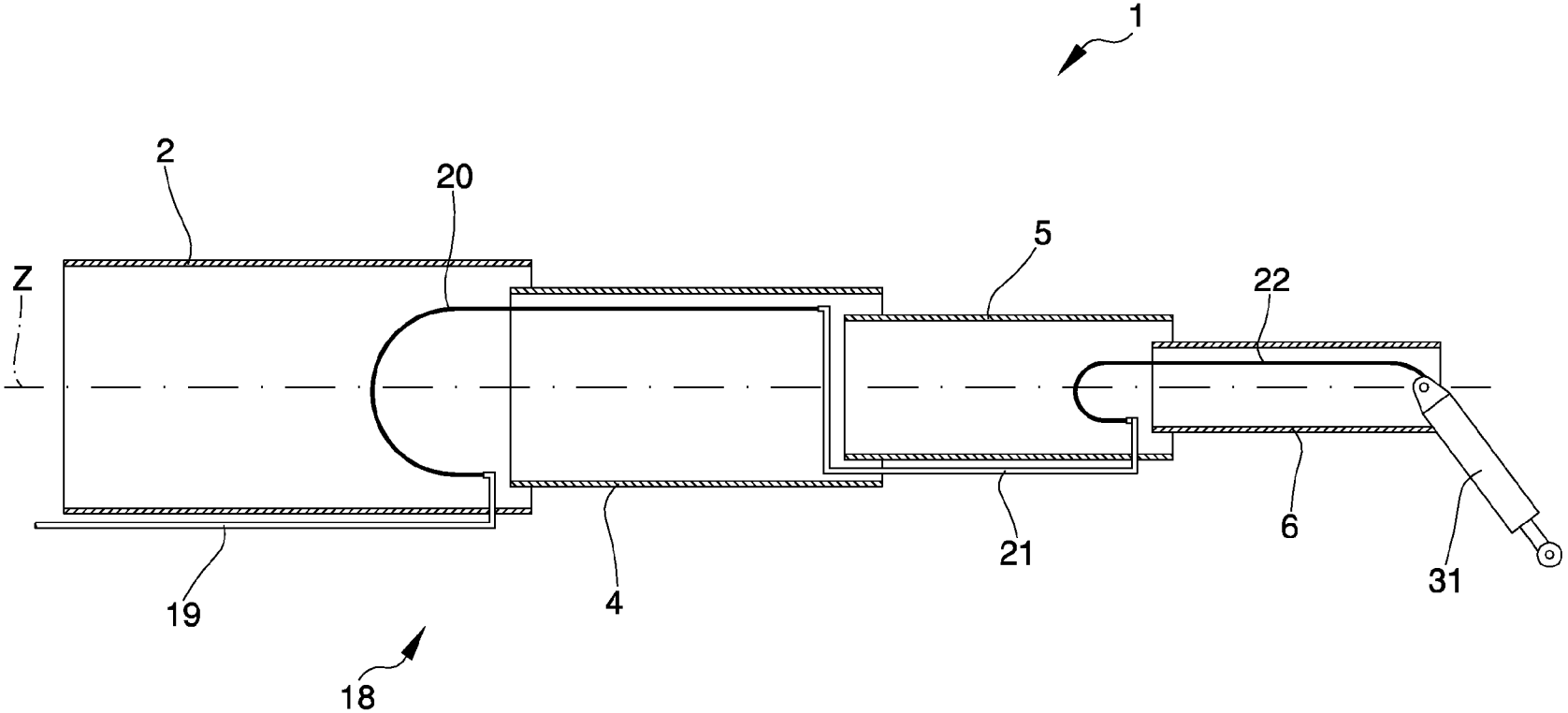
FIG. 3 is a schematic side view, showing an arrangement of conduit of the telescopic boom of FIG. 1 in the extended configuration.

The telescopic boom 1 may comprise an arrangement of conduits 18, shown in FIG. 3, for sending an operating fluid, for example pressurized oil, from a source located on the loading machine to a point of use which may be the hydraulic actuator element 31 connected to the third movable section 6.

A group of conduits of the arrangement of conduits 18 may be obtained inside rigid tubes, which have been indicated with the colour white in FIG. 3. A further group of conduits of the arrangement of conduits 18 may be obtained inside flexible hoses, which have been indicated with the colour black in FIG. 3.

In particular, a rigid tube 19 may be provided along the base section 2. The rigid tube 19 may have a longitudinal segment extending externally of the base section 2, for example parallelly to the longitudinal axis Z.

A flexible hose 20 is connected to the rigid tube 19 and is associated to the first movable section 4. In the retracted configuration, a substantial segment of the flexible hose 20 is located in an interspace between the first movable section 4 and the second movable section 5.

A further rigid tube 21 is in fluid communication with the flexible hose 20 and has a respective longitudinal segment extending along the second movable section 5, externally of the second movable section 5.

A further flexible hose 22 has an end connected to the further rigid tube 21 and a further end in fluid communication with the hydraulic actuator element 31. When the telescopic boom 1 is in the retracted configuration, a substantial segment of the further flexible hose 22 is received inside the third movable section 6.

The flexible hose 20 is associated to a movable section interposed between two sections to which rigid tubes are associated, namely the base section 2 and the second movable section 5. Similarly, a rigid tube, namely the further rigid tube 21, is associated to a movable section interposed between two sections to which flexible hoses are associated, namely the first movable section 4 and the third movable section 6.

Thus, in an extended configuration of the telescopic boom 1, there is an alternating distribution of rigid tubes and flexible hoses along the longitudinal axis Z. This alternating distribution makes it easier to avoid undesired interference between the flexible hoses and the rigid tubes, even in the retracted configuration.

The flexible hoses are staggered on two sides of the longitudinal axis Z with respect to the rigid tubes. In other words, the rigid tube 19 and the further rigid tube 21 are arranged on a side of the longitudinal axis Z which is opposite with respect to the flexible hose 20 and the further flexible hose 22. In the embodiment of FIG. 3, the rigid tube 19 is arranged on the lower side of the telescopic boom 1, i.e. below the longitudinal axis Z. The flexible hose 20 is arranged opposite the rigid tube 19 relative to the longitudinal axis Z, i.e. on the upper side of the telescopic boom.

The further rigid tube 21 is arranged on the same side as the rigid tube 19 relative to the longitudinal axis Z, for example on the lower side of said axis. The further flexible hose 22 is arranged on a side opposite the further rigid tube 21 relative to the longitudinal axis, for example on an upper side of the longitudinal axis.

In the embodiment of FIG. 1, the flexible hoses and the rigid tubes are associated to sides of the telescopic boom 1 opposite the extension and retraction chains relative to the longitudinal axis Z. Thus, on the lower side of a section forming the telescopic boom 1, either a chain or a conduit of the conduit arrangement 18 can be found. Similarly, on the upper side of a section forming the telescopic boom, either a conduit of the conduit arrangement 18 or a chain is located. By so doing, it is easier to position the chains and the conduits in the telescopic boom 1, because the chains do not interact with the conduits and vice versa.

Figure 4:
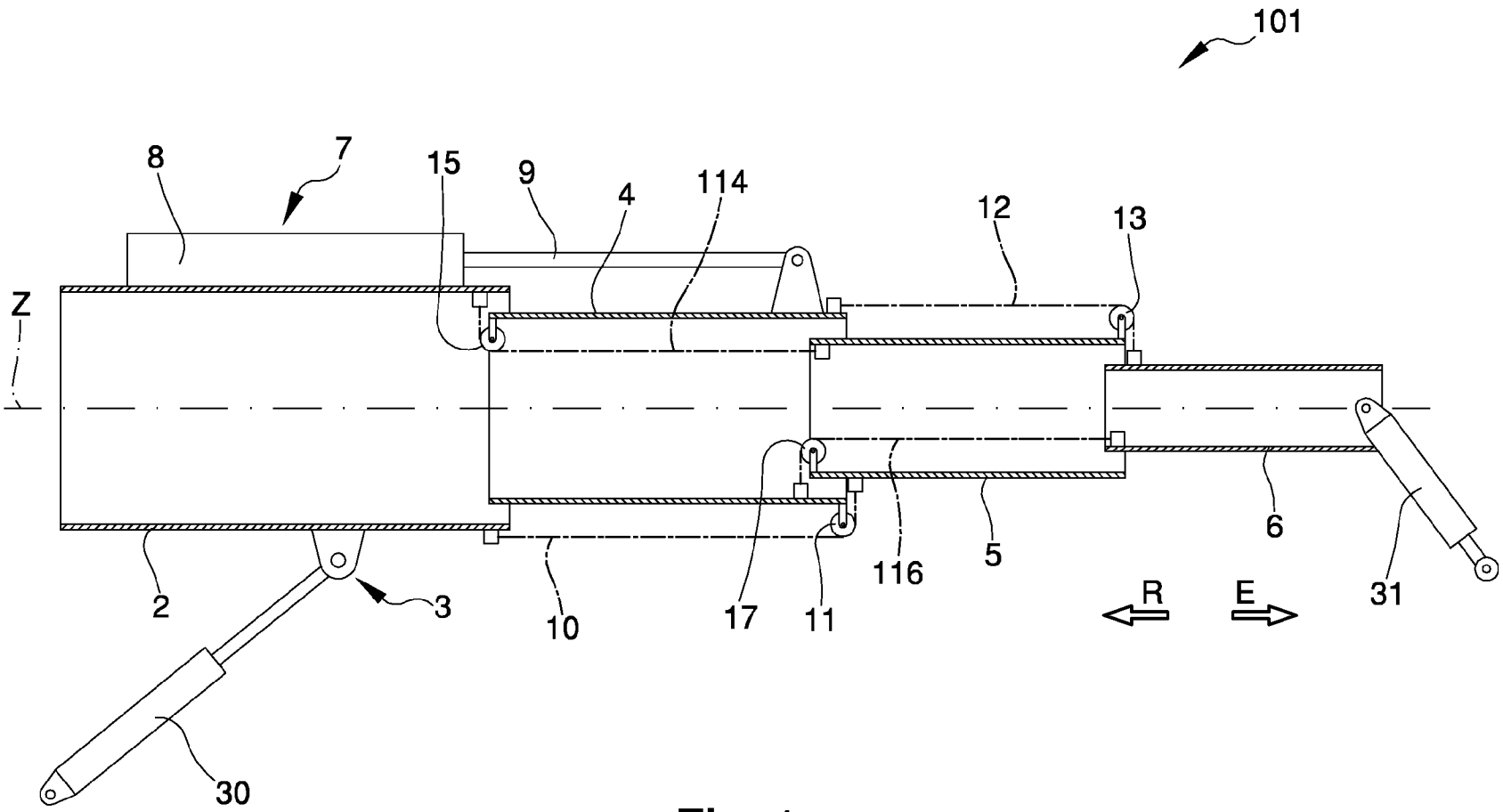
FIG. 4 is a view like FIG. 1, showing a telescopic boom according to an alternative embodiment.

FIG. 4 shows a telescopic boom 101 according to an alternative embodiment.

The components of the telescopic boom 101 similar to the telescopic boom 1 will be indicated with the same reference numerals used in FIGS. 1 to 3 and will not be described again in detail. The telescopic boom 101 differs from the telescopic boom 1 mainly for the arrangement of the retraction chains.

In particular, the retraction chain 114, instead of being on the same side as the extension chain 10 relative to the longitudinal axis Z, is on the opposite side of the longitudinal axis Z with respect to the extension chain 10. In other words, the retraction chain 114 is located on the upper side of the telescopic boom 101, i.e. above the longitudinal axis Z.

In the extended configuration, the retraction chain 114 still extends inside the first movable section 4.

The further retraction chain 116, as in the previous embodiment, is located on the side opposite the retraction chain 114 relative to the longitudinal axis Z. Thus, in the extended configuration of the embodiment shown in FIG. 4, the further retraction chain 116 is positioned on the lower side of the second movable section 5, i.e. below the longitudinal axis Z. The further retraction chain 116 is located on a side of the telescopic boom 101 opposite the further extension chain 12 relative to the longitudinal axis Z.

In the embodiments of FIGS. 1 and 4, the hydraulic cylinder 7 is located on an upper side of the hydraulic boom, i.e. above the longitudinal axis Z.

However, the hydraulic cylinder 7 could also be located on a lower side of the hydraulic boom, i.e. below the longitudinal axis Z. This location of the hydraulic cylinder 7 could be combined with an arrangement of chains as shown in FIG. 1, but in which the extension chains 10, 12 and the retraction chains 14, 16 are in a position which is mirrored relative to the longitudinal axis Z if compared to the position shown in FIG. 1. As an alternative, the hydraulic cylinder 7 located below the longitudinal axis Z could be combined with an arrangement of chains as shown in FIG. 4, but in which the extension chains 10, 12 and the retraction chains 114, 116 are in a position which is mirrored relative to the longitudinal axis Z if compared to the position shown in FIG. 4. Thus, also in the latter two embodiments, the hydraulic cylinder 7 and the chains associated to the first movable section 4 are at opposite sides of the longitudinal axis Z, which ensures a balanced stress distribution.

The invention claimed is:

1. A telescopic boom extending along a longitudinal axis, comprising:

a base section configured for connection to a frame of a machine for lifting loads;

a plurality of movable sections;

a hydraulic cylinder connecting the base section to a first movable section of the plurality of movable sections for extending the first movable section relative to the base section;

at least one extension chain between the base section and a second movable section of the plurality of movable sections for extending the second movable section relative to the first movable section, the at least one extension chain positioned near an outer portion of the first movable section when the telescopic boom is in an extended configuration;

at least one retraction chain positioned near an inner portion of one of the plurality of movable sections when the telescopic boom is in the extended configuration; and at least another extension chain interposed between the first movable section and a third movable section of the plurality of movable sections for extending the third movable section relative to the second movable section, the at least another extension chain positioned near an outer portion of the second movable section when the telescopic boom is in the extended configuration, wherein when the telescopic boom is in the extended configuration, the at least one extension chain and the at least one retraction chain are positioned near each other and separated by a portion of one movable section, the at least one extension chain and the at least one retraction chain each located at a same side of the longitudinal axis.

2. The telescopic boom according to claim 1, wherein the hydraulic cylinder is located at a side of the longitudinal axis opposite the at least one extension chain, and wherein a portion of the hydraulic cylinder is connected to an outer portion of the base section.

3. The telescopic boom according to claim 1, wherein the at least one extension chain is located on a lower side of the telescopic boom and the at least another extension chain is located on an upper side of the telescopic boom.

4. The telescopic boom according claim 1, wherein the at least one extension chain has an end anchored to a forward portion of the base section and an opposite end anchored to a rearward portion of the second movable section, the at least one extension chain being wound on a pulley provided at a forward end of the first movable section.

5. The telescopic boom according to claim 1, wherein the at least another extension chain has an end anchored to a forward portion of the first movable section and an opposite end anchored to a rearward portion of the third movable section, the at least another extension chain being wound on a further pulley provided at a forward end of the second movable section.

6. The telescopic boom according to claim 1, further comprising at least another retraction chain interposed between the first movable section and the third movable section of the plurality of movable sections for retracting the third movable section relative to the first movable section, the at least another retraction chain positioned near an inner portion of the second movable section when the telescopic boom is in the extended configuration.

7. A telescopic boom according to claim 1, further comprising an arrangement of conduits for sending an operating fluid from a source to a point of use on the third movable section, wherein a group of conduits of the arrangement of conduits is obtained inside rigid tubes, and a further group of conduits of the arrangement of conduits obtained inside flexible hoses, and wherein when the telescopic boom is in the extended configuration a substantial portion of the rigid tubes are external relative to the plurality of movable sections.

8. The telescopic boom according to claim 7, wherein, when the telescopic boom is in the extended configuration, the rigid tubes and the flexible hoses form a sequence along the longitudinal axis, such that one of the flexible hoses is in a position interposed between two of the rigid tubes in the sequence, and vice versa, and wherein a substantial portion of the rigid tubes are internal relative to the movable sections.

9. The telescopic boom according to claim 8, wherein when the telescopic boom is in the extended configuration, the conduits of the conduit arrangements have respective segments running parallel to the longitudinal axis, each of the segments being associated with one of the plurality of movable sections in a position opposite a chain associated with the one of the plurality of movable sections with respect to the longitudinal axis.

10. The telescopic boom according to claim 1, wherein the hydraulic cylinder is located external to the plurality of movable sections and a portion of the hydraulic cylinder is connected to an outer portion of one of the plurality of movable sections.

11. A telescopic boom extending along a longitudinal axis, comprising:

a base section configured for connection to a frame of a machine for lifting loads;

a plurality of movable sections;

a hydraulic cylinder connecting the base section to a first movable section of the plurality of movable sections for extending the first movable section relative to the base section;

at least one extension chain connected between the base section and a second movable section of the plurality of movable sections for extending the second movable section relative to the first movable section, the at least one extension chain positioned outside an outer portion of the first movable section when the telescopic boom is in an extended configuration;

at least one retraction chain connected between the base section and the second movable section of the plurality of movable sections for retracting the second movable section relative to the first movable section, the at least one retraction chain positioned inside an inner portion of one of the plurality of movable sections when the telescopic boom is in the extended configuration; and at least another extension chain connected between the first movable section and a third movable section of the plurality of movable sections for extending the third movable section relative to the second movable section, the at least another extension chain positioned outside an outer portion of the second movable section when the telescopic boom is in the extended configuration, wherein when the telescopic boom is in the extended configuration, the at least one extension chain and the at least one retraction chain are positioned on opposite sides of a wall of the first movable section, the at least one extension chain and the at least one retraction chain each located at a same side of the longitudinal axis.

12. The telescopic boom according to claim 11, wherein the hydraulic cylinder is located at a side of the longitudinal axis opposite the at least one extension chain, and wherein a portion of the hydraulic cylinder is connected to an outer portion of the base section.

13. The telescopic boom according to claim 11, wherein the at least one extension chain is located on a lower side of the telescopic boom and the at least another extension chain is located on an upper side of the telescopic boom.

14. The telescopic boom according claim 11, wherein the at least one extension chain has an end anchored to a forward portion of the base section and an opposite end anchored to a rearward portion of the second movable section, the at least one extension chain being wound on a pulley provided at a forward end of the first movable section.

15. The telescopic boom according to claim 11, wherein the at least another extension chain has an end anchored to a forward portion of the first movable section and an opposite end anchored to a rearward portion of the third movable section, the at least another extension chain being wound on a further pulley provided at a forward end of the second movable section.

16. The telescopic boom according to claim 11, further comprising at least another retraction chain connected between the first movable section and the third movable section of the plurality of movable sections for retracting the third movable section relative to the first movable section, the at least another retraction chain positioned inside an inner portion of the second movable section when the telescopic boom is in the extended configuration.

17. The telescopic boom according to claim 11, further comprising an arrangement of conduits for sending an operating fluid from a source to a point of use on the third movable section, wherein a group of conduits of the arrangement of conduits is obtained inside rigid tubes, and a further group of conduits of the arrangement of conduits obtained inside flexible hoses, and wherein when the telescopic boom is in the extended configuration a substantial portion of the rigid tubes are external relative to the plurality of movable sections.

18. The telescopic boom according to claim 17, wherein, when the telescopic boom is in the extended configuration, the rigid tubes and the flexible hoses form a sequence along the longitudinal axis, such that one of the flexible hoses is in a position interposed between two of the rigid tubes in the sequence, and vice versa, and wherein a substantial portion of the rigid tubes are internal relative to the movable sections.

19. The telescopic boom according to claim 18, wherein, when the telescopic boom is in the extended configuration, the conduits of the conduit arrangements have respective segments running parallel to the longitudinal axis, each of the segments being associated with one of the plurality of movable sections in a position opposite a chain associated with the one of the plurality of movable sections with respect to the longitudinal axis.

20. The telescopic boom according to claim 11, wherein the hydraulic cylinder is located external to the plurality of movable sections and a portion of the hydraulic cylinder is connected to an outer portion of one of the plurality of movable sections.

21. A telescopic boom extending along a longitudinal axis, comprising:

a base section configured for connection to a frame of a machine for lifting loads;

a plurality of movable sections;

a hydraulic cylinder connecting the base section to a first movable section of the plurality of movable sections for extending the first movable section relative to the base section;

at least one extension chain between the base section and a second movable section of the plurality of movable sections for extending the second movable section relative to the first movable section, the at least one extension chain positioned near an outer portion of the first movable section when the base section and the second movable section are in an extended position;

at least one retraction chain positioned near an inner portion of one of the plurality of movable sections when the telescopic boom is in an extended configuration; and at least another extension chain interposed between the first movable section and a third movable section of the plurality of movable sections for extending the third movable section relative to the second movable section, the at least another extension chain positioned near an outer portion of the second movable section when the first movable section and the third movable section are in an extended position, wherein when the telescopic boom is in the extended configuration, the at least one extension chain and the at least one retraction chain are positioned near each other and separated only by a portion of one movable section, the at least one extension chain and the at least one retraction chain each located at a same side of the longitudinal axis, wherein the hydraulic cylinder is located external to the plurality of movable sections and a portion of the hydraulic cylinder is connected to an outer portion of one of the movable sections, wherein the at least one retraction chain is interposed between the base section and the second movable section for retracting the second movable section relative to the first movable section when the base section and the second movable section are in the extended position, and wherein at least a further retraction chain is interposed between the first movable section and the third movable section of the plurality of movable sections for retracting the third movable section relative to the first movable section, the at least further retraction chain positioned near an inner portion of the second movable section when the base section and the second movable section are in the extended position.

* * * * *